United States Patent [19]

Callahan

[11] Patent Number: 4,844,779

[45] Date of Patent: Jul. 4, 1989

[54] METAL TREATMENT CLAMP AND METHOD AND APPARATUS FOR USING THE SAME

[76] Inventor: Norman F. Callahan, 455 Barn Hill Rd., Monroe, Conn. 06468

[21] Appl. No.: 147,878

[22] Filed: Jan. 25, 1988

[51] Int. Cl.[4] ..... C25D 5/00; C25D 17/00

[52] U.S. Cl. ..... 204/23; 204/242; 204/279; 439/729

[58] Field of Search ..... 204/23, 242, 279; 439/726, 729, 822, 829

[56] References Cited

U.S. PATENT DOCUMENTS 2,522,810 9/1950 Bailey ..... 439/729

*Primary Examiner*—T. M. Tufariello

[57] ABSTRACT

In a plating or anodizing operation, improved plating clamps are utilized to provide positive electrical connection between a work holding rack and an electrical conducting bus bar. In each of the clamps, the spring thereof is completely insulated from the electrical conducting bus bar to prevent failure thereof due to over heating.

17 Claims, 2 Drawing Sheets

METAL TREATMENT CLAMP AND METHOD AND APPARATUS FOR USING THE SAME

BACKGROUND OF THE INVENTION

The present invention relates generally to the metal treatment industry, and more particularly to clamps used to secure work holding racks to bus bars during such operations.

In anodizing and plating operations, metal parts are required to be immersed into tanks containing an electrolytic solution. The parts are first placed in a container or onto racks before being immersed into the electrolyte. The containers and racks are generally constructed of an electrically conductive material, such as, aluminum because the metal treatment operation necessitates the passing of an electric current through the parts to be treated and the electrolyte.

The containers and racks are typically hung from an electric current carrying bus bar positioned over the plating tank. The bus bar conducts a source of electrical current to the racks and through the parts to be treated and through the electrolyte and finally to a ground terminal.

Because the current in effect passes through the bus bar and into the work rack, it is essential there be a reliable electrical contact between the bus bar and the rack to insure no electrical losses occur. As should be apparent to those skilled in the art, the point of contact between the rack and the bus bar is called the rack arm. Various means have been employed to hold the rack arm to the bus bar such as by bolting the rack on to the bus bar, or by utilizing a cast iron or plastic "C" clamp, or by utilizing locking pliers.

Each of these types of devices have their respective advantages and disadvantages. The common disadvantage, of each of the above named tools, is that the use thereof is time consuming. Furthermore, tools such as locking pliers are expensive.

One tool, the woodworker's steel spring clamp, is both quickly utilized during metal treating operations and inexpensive to manufacture. This is a tool characterized by a pair of steel hand grips or tongs and a spring which forces the steel tongs into closure. The typical woodworker's clamp is essentially comprised of four (4) main parts: two juxtaposed arms or tongs, a spring which forces the holding ends of the arms together in a clamping action, and a tubular rivet which holds the two arms in a pivoted relationship.

During plating and anodizing operations, the bus bars become corroded through contact with the electrolyte solution splash. In addition, the rack arms distorted, corroded and oxidized. In these instances, the optimum ideal situation of a clean bus bar and flat conductive surface joined intimately by a clamping device is not present. Experience with the use of woodworker's spring clamps in such operations under the aforementioned conditions wherein the contact between the rack arms and the bus bar is marginal has shown that a disproportionate part of the incoming current passing through the bus bar is oftentimes diverted up through the clamp following the path of least resistance rather than down the rack arm and into the work load in the tank. This occurs probably because one of the pressured spring ends makes positive contact with the back side of the bus bar. When this occurs the high current passing through the clamp and into the coil causes it to become in effect a glow coil, heating up to a cherry red to orange color equivalent to approximately 1300 to 1600 degrees Fahrenheit. The spring immediately loses physical properties and the clamp has no holding power, becomes non-functional and is usually discarded.

The present invention is designed to overcome the above noted limitations that are attendant upon the use of prior art clamping and securing devices of the metal treatment industry, and toward this end, it contemplates the provision of a novel clamping device for assuring positive electrical contact between rack arm and the electrical current carrying bus bar during a metal treatment operation.

It is an object of the invention to provide such a clamping device which can be easily and efficiently used during such an operation with increased reliability.

Still another object is to provide such a device which prevents shunting of electrical current through the coil spring thereby eliminating undesirable heating and failure thereof.

A further object is to provide such a device which may be readily and economically fabricated and will enjoy a long life in operation.

SUMMARY OF THE INVENTION

It has now been found that the foregoing and related objects can be readily attained in a clamping device which eliminates the primary reason for failure of the woodworker's clamp in plating and anodizing operations, namely, the failure of the spring which is the heart of the clamp. In this invention, this is accomplished by electrically insulating the spring from the clamp proper thereby completely isolating the spring from the electrical circuit.

The spring insulation is achieved by the use of fittings made of delrin, nylon, teflon, micarta or other similar insulating or dielectric materials. A three piece spool for example made of insulating material and consisting of a tubular body with stepped down flanged ends which can be pressed onto the tubular body to form a spool shaped part is utilized for insulating the central part of the coil spring. By pressing one flange onto the body and inserting this through the coil spring and then pressing on the other flange, the coil and end parts of the spring are insulated from the clamp arms and tubular rivet which will pass through the core of the insulating spool. By inserting insulating blind tubular end caps on the two end extensions of the spring the entire spring then becomes insulated from the clamp proper.

In accordance with the invention, the improved clamp is essentially comprised of a pair of steel arms, a spring, a spool made from an insulated or dielectric material, and a pair of insulated or dielectric bushings or caps inserted at each end of the pair of extended spring arms that contact the internal surface of the pair of clamping arms.

The invention will be more fully understood when reference is made to the following detailed description taken in conjunction with the accompanying drawings.

DETAIL DESCRIPTION OF THE PREFERRED EMBODIMENT

Figure 1:
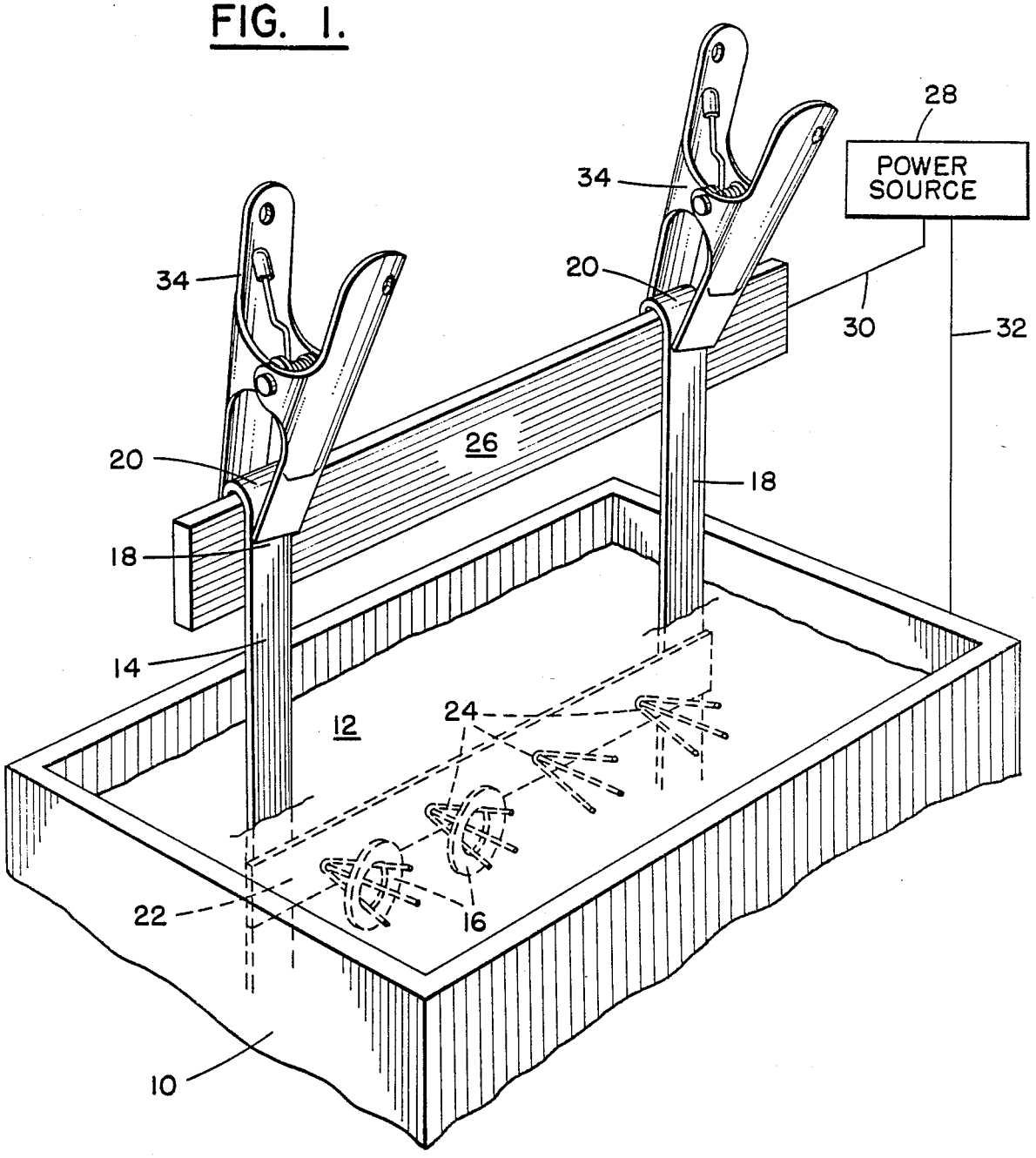
FIG. 1 is a perspective view of a plating operation with plating rack suspended from a bus bar and extending into an electrolytic solution, a pair of plating clamps of the present invention hold the rack arms to the bus bar.

Referring first to FIG. 1, therein illustrated is a metal treatment operation such as plating or anodizing in accordance with the present invention. Provided in the metal treatment operation is a tank 10 of electrolytic solution 12 in which is suspended a metal treatment rack 14 having a plurality of workpieces 16 (in this case, washers) thereon. The rack 14 has a pair of rack arms 18 with hook shaped upper ends 20.

Spanned between the rack arms 16 are workpiece holding strips 22 with workpiece holders 24 thereon. Each of the workpiece holders 24 is in the form of three pins designed to hold the individual workpieces 16 utilizing a resilient biasing pressure.

The rack 14 is suspended from an electrically conducting bus bar 26 connected to a power source 28 through line 30. The power source 28 is also connected to the electrolytic solution through line 32. As will be explained further hereinafter, line 32 is connected to the tank 10 or to suitable anodes (not shown) depending upon whether the operation is plating or anodizing.

Figure 2:
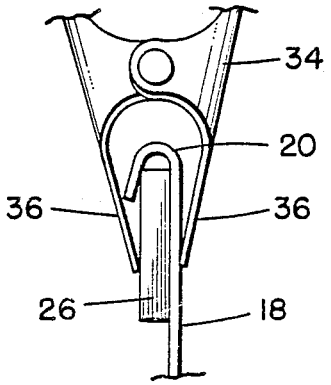
FIG. 2 is a fragmentary side elevational view of the bus bar, rack and clamp of the present invention.

To provide a positive electrical connection between the rack arms 18 and the bus bar 26, a pair of clamps 34 are used to clamp the rack 14 to a bus bar 26. The clamps 34 are angled, if necessary, relative to the bus bar 26 with the backs of the clamps 34 on the bus bar 26 so as to draw the flat sides of the rack arms 18 against the bus bar 26 and hold it tightly in the position illustrated in FIG. 2.

Figure 3:
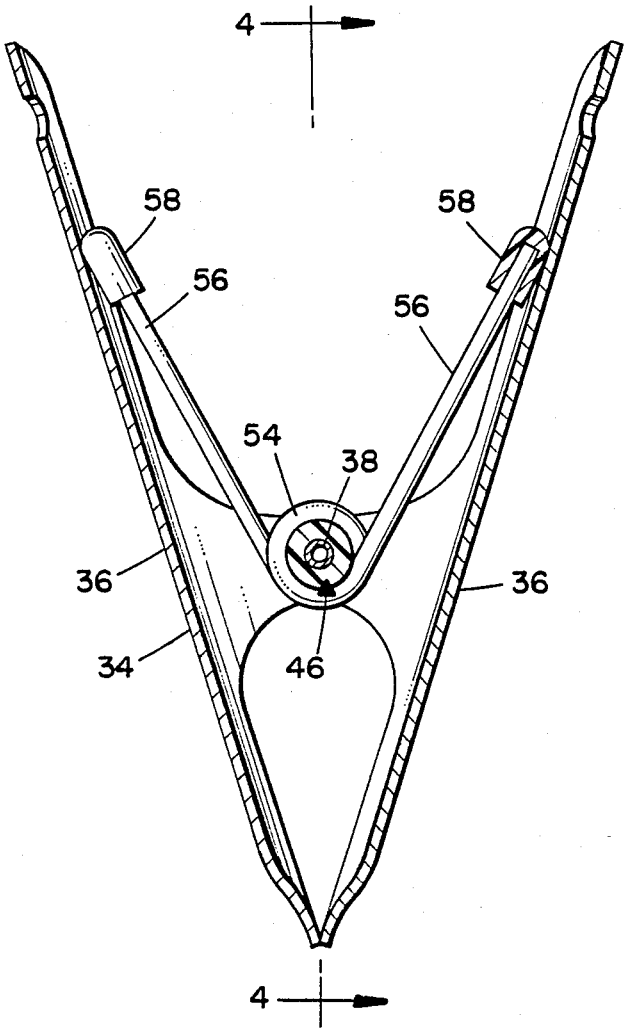
FIG. 3 is a cross-sectional view of the plating clamp of the present invention including the spring and associated insulating parts.
Figure 4:
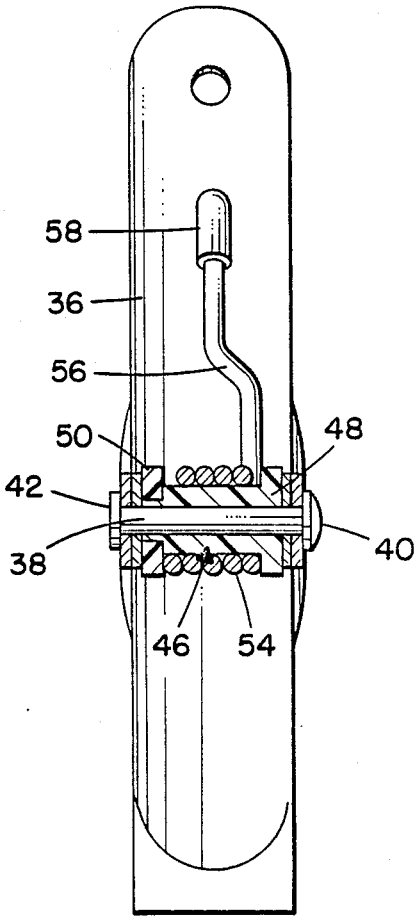
FIG. 4 is a cross-sectional view of the plating clamp of FIG. 2 taken along the 4—4 line of FIG. 3.
Figure 5:
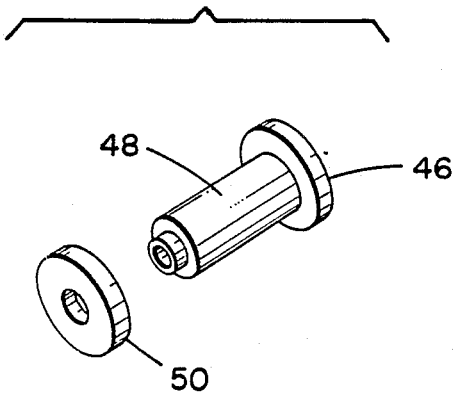
FIG. 5 is an exploded view of the insulating parts of the present invention.

Turning now to FIGS. 3 and 4, each of the clamps 34 has a pair of juxtaposed clamp arms 36 made from a material such as stainless or plain carbon steel. The clamp arms 36 are pivotally connected by a tubular rivet 38 having, on one end, a pivot head 40 and, at the opposite end, a swagable or flared surface end 42. An insulated or dielectric spool assembly generally indicated by numeral 46 surrounds the tubular rivet 38 and is mounted within the clamp arms 36. As seen in FIG. 5, the spool assembly can be an insulated or dielectric spool body with an insulated or dielectric spool end 50. But it should be appreciated that the spool assembly 46 can be manufactured as a three piece assembly having two larger radius spool ends and a smaller radius spool body with stepped down ends.

Surrounding the spool assembly 46 and biasing the clamp arms 36 into clamping engagement is a coil spring 54 with a pair of extending spring arms 56 engaging the associated clamp arms 36. Each of the spring arms 56 is capped with an insulated or dielectric end cap 58 compressed against its associated clamp arm 36. Accordingly, the spring 54 is completely electrically insulated by the spool assembly 46 and end caps 58 from the clamp arms 36.

The insulated or dielectric spool assembly and end caps are preferably molded or machined from a plastic resins such as delrin, nylon, teflon, polypropylene or micarta but it should be apparent to those skilled in the art that they can be manufactured from other suitable materials which exhibit corrosive resistant and insulating qualities.

Referring again to FIG. 1, in performing the invention and utilizing the clamps 34, the workpieces 16 are initially placed on the workholders 24 of the rack 14. The rack 14 is then hung on the bus bar 26 with the hook shaped ends 20 of the rack arms 18 engaging the bus bar 26. The workpieces 24 and a portion of the rack 14 are thereby suspended in the electrolytic solution 12. With the rack 14 being thus temporarily suspended, the user's hands are free to place the clamps 34 in their angled orientation to press the flat side of the rack arms 18 against the bus bar 26 to establish electrical contact therebetween.

The workpieces 16 will be plated or anodized when the electrical power source 28 is energized. In anodizing the workpieces 16, the anode (not shown) and the tank 10 (if it is made of conductive material such as lead or stainless steel) are connected to the cathode line. If the tank is made of plastic then plates (not shown) of lead or aluminum are hung on the sides of the tank 10 and connected to the cathode line coming from the power source 28. On the other hand, in plating, it is the opposite, with the workpieces 16 being electrically connected to the cathode line through the bus bar 26 and the rack 14 while the metal plating material is a bar or plate attached to the anode line submersed in the electrolytic solution 12. Some plating processes use insoluble anodes, the metal to be plated is part of the electrolytic solution 12 and the tank 10 if conductive would be connected to the anode line. In either a plating or anodizing operation, the spring 52 of the present invention will not over heat as it is electrically insulated from the rest of the electrical circuit.

Thus, it can be seen from the foregoing specification and attached drawings that the clamp of the present invention provides an effective means for establishing electrical contact between a metal treatment rack and bus bar during a metal treatment operation.

The preferred embodiment admirably achieves the objects of the present invention; however, it should be appreciated that departures can be made by those skilled in the art without departing from the spirit and scope of the invention which is limited only by the following claims.

Having thus described the invention, I claim:

1. A clamp for use in a metal treatment operation such as plating or anodizing comprising two pivotally connected juxtaposed clamp arms; a spring operatively connected to said juxtaposed clamp arms and resiliently loading the same into a clamping relationship, said spring has a pair of extending spring arms, the spring arms engaging said juxtaposed arms and biasing them into clamping engagement; and electrical insulating means electrically isolating said spring from said juxtaposed clamp arms thereby preventing electrical current from flowing through said spring when electrical current is flowing through said clamp arms during a metal treatment operation, wherein said electrical insulating means includes:

a pair of dielectric caps inserted on the end of each of the spring arms providing electrical insulation between the spring and the clamp arms.

2. The clamp as set forth in claim 1, wherein said spring is a coil spring with a central coil body.

3. The clamp as set forth in claim 2, wherein said electrical insulating means comprises:

a dielectric spool inserted within the coil body of the spring providing an electrical insulation between the spring and the pivoted clamp arms.

4. Apparatus for performing a metal treatment operation such as plating or anodizing comprising:

means containing an electrolytic solution;

electrically conducting bus bar means extending over said means containing said electrolytic solution;

workpiece holding rack with workpieces held on said rack, said rack and workpieces being at least partially submersed in said electrolytic solution;

at least one clamp releasably securing said workpiece holding rack to said bus bar and providing positive electrical connection therebetween, said at least one clamp including two pivotally connected juxtaposed clamp arms, a spring operatively connected to said juxtaposed clamp arms and resiliently loading the same into a clamping relationship, and electrical insulating means electrically isolating said spring from said juxtaposed clamp arms thereby preventing electrical current from flowing through said spring when electrical current is flowing through said clamp arms during a metal treatment operation; and power supply means electrically connected to said bus bar and said means containing said electrolytic solution for providing electrical power for the metal treatment operation.

5. The apparatus as set forth in claim 4, wherein said spring is a coil spring with a central coil body.

6. The apparatus as set forth in claim 5, wherein said electrical insulating means comprises:

a dielectric spool inserted within the coil body of the spring providing an electrical insulation between the spring and the pivoted clamp arms.

7. The apparatus as set forth in claim 6, wherein said spring has a pair of extending spring arms, the spring arms engaging said juxtaposed arms and biasing them into clamping engagement.

8. The apparatus as set forth in claim 7, wherein said electrical insulating means further includes:

a pair of dielectric caps inserted on the end of each of the spring arms providing electrical insulation between the spring and the clamp arms.

9. The apparatus as set forth in claim 4, wherein said spring has a pair of extending spring arms, the spring arms engaging said juxtaposed arms and biasing them into clamping engagement.

10. The apparatus as set forth in claim 9, wherein said electrical insulating means includes:

a pair of dielectric caps inserted on the end of each of the spring arms providing electrical insulation between the spring and the clamp arms.

11. Method for performing a metal treatment operation such as plating or anodizing comprising the steps of:

providing an electrolytic solution;

providing electrically conducting bus bar means extending over said electrolytic solution;

hanging a workpiece holding rack with workpieces thereon on said bus bar with said rack and workpieces being at least partially submersed in said electrolytic solution;

using at least one clamp to releasably secure said workpiece holding rack to said bus bar and provide positive electrical connection therebetween, said at least one clamp including two pivotally connected juxtaposed clamp arms, a spring operatively connected to said juxtaposed clamp arms and resiliently loading the same into a clamping relationship, and electrical insulating means electrically isolating said spring from said juxtaposed clamp arms thereby preventing electrical current from flowing through said spring when electrical current is flowing through said clamp arms during a metal treatment operation; and energizing power supply means electrically connected to said bus bar and said electrolytic solution to provide electrical power for the metal treatment operation.

12. The method as set forth in claim 11, wherein said spring is a coil spring with a central coil body.

13. The method as set forth in claim 12, wherein said electrical insulating means comprises:

a dielectric spool inserted within the coil body of the spring providing an electrical insulation between the spring and the pivoted clamp arms.

14. The method as set forth in claim 13, wherein said spring has a pair of extending spring arms, the spring arms engaging said juxtaposed arms and biasing them into clamping engagement.

15. The method as set forth in claim 14, wherein said electrical insulating means further includes:

a pair of dielectric caps inserted on the end of each of the spring arms providing electrical insulation between the spring and the clamp arms.

16. The method as set forth in claim 11, wherein said spring has a pair of extending spring arms, the spring arms engaging said juxtaposed arms and biasing them into clamping engagement.

17. The method as set forth in claim 16, wherein said electrical insulating means includes:

a pair of dielectric caps inserted on the end of each of the spring arms providing electrical insulation between the spring and the clamp arms.

* * * * *